US007281878B2

(12) United States Patent
Schulz

(10) Patent No.: US 7,281,878 B2
(45) Date of Patent: Oct. 16, 2007

(54) ROAD SURFACE SOUND REDUCTION SYSTEM

(76) Inventor: Gary Schulz, 417 High Rd., Cary, IL (US) 60013

( * ) Notice: Subject to any disclaimer, the term of this patent is extended or adjusted under 35 U.S.C. 154(b) by 0 days.

(21) Appl. No.: 11/416,816

(22) Filed: May 3, 2006

(65) Prior Publication Data

US 2006/0198696 A1 Sep. 7, 2006

Related U.S. Application Data

(63) Continuation-in-part of application No. 11/273,422, filed on Nov. 14, 2005, now abandoned, which is a continuation-in-part of application No. 11/073,066, filed on Mar. 3, 2005, now abandoned.

(60) Provisional application No. 60/589,770, filed on Jul. 21, 2004.

(51) Int. Cl.
*E01C 11/00* (2006.01)

(52) U.S. Cl. ..... 404/17; 404/71; 404/72

(58) Field of Classification Search ..... 404/17, 404/19, 71, 72, 75
See application file for complete search history.

(56) References Cited

U.S. PATENT DOCUMENTS

| | | | | |
|---|---|---|---|---|
| 2,457,512 | A | 12/1948 | Wheeler | |
| 2,574,090 | A | 11/1951 | Dofsen | |
| 3,529,517 | A | 9/1970 | Liddle et al. | |
| 3,595,143 | A | 7/1971 | Polselli | |
| 6,259,374 | B1 | 7/2001 | Kisner et al. | |
| 7,121,761 | B2 * | 10/2006 | Woodruff | 404/17 |
| 2003/0026655 | A1 | 2/2003 | Schmidt | |
| 2004/0240937 | A1 | 12/2004 | Woodruff | |

FOREIGN PATENT DOCUMENTS

KR 2004-371236 * 1/2004

OTHER PUBLICATIONS

'Evaluation of Tining Widths to Reduce Noise of Concrete Runways, Final Report,' North Dakota Department of Transportation Materials and Research Division, Nov. 1997 (22 pages).*

'Special Report, Concrete Pavement Technology & Research,' American Concrete Pavement Association, 2000 (12 pages).*

'Notes to the Specification for Improvement of Pavment Macrotexture,' Transit New Zealand Ararau Aotearoa, 2003 (4 pages).*

Kuemmel et al., "Noise and Texture on PCC Pavements", Final-Report WI/SPR-08-99, written for the Wisconsin Dept. of Transportation, Madison, WI, Jun. 2000.

* cited by examiner

*Primary Examiner*—Gary S. Hartmann
(74) *Attorney, Agent, or Firm*—Banner & Witcoff, Ltd.

(57) ABSTRACT

A method for reducing tire to road noise generated by vehicles on a road surface comprises generating a pseudo-random unique line pattern, providing said pattern as transverse grooves disposed in the road surface, said grooves being randomized according said line pattern as to one or more of position, frequency, and depth so as to spread the noise spectrum thereby reducing the amplitude or volume of noise generated at any single frequency and are capable of dramatic reductions in noise generated by high speed traffic on roadways. It can be implemented by conventional construction practice at little or no additional cost and eliminates the need for costly structures such as noise barrier fencing in residential areas.

3 Claims, 4 Drawing Sheets

Randomization of both line spacing (position) and groove depth

Pseudorandom line/groove spacing (centered at 1")

Randomization of both line spacing (position) and groove depth

ROAD SURFACE SOUND REDUCTION SYSTEM

CROSS REFERENCE TO RELOCATED APPLICATIONS

This application is a continuation-in-part of U.S. patent application Ser. No. 11/273,422 filed Nov. 14, 2005 now abandoned, which is a continuation-in-part of U.S. patent application Ser. No. 11/073,066 filed Mar. 3, 2005 now abandoned, which is a continuation of U.S. Provisional Patent Application No. 60/589,770, filed Jul. 21, 2004. This application incorporates by reference the aforementioned prior applications.

FIELD OF THE INVENTION

This invention pertains to road surface noise emission by moving vehicles and more particularly to a system for reduction of the noise emitted from tires over road rolling contact.

BACKGROUND OF THE INVENTION

Various studies have found that the noise signature produced by traffic on any moderate to high speed roadway is composed of the following elements: 1) Tire to pavement noise due to contact between the rubber surface of the tread on a tire and the surface of the road itself; 2) Aerodynamic noises; 3) Engine/exhaust noise due to the combustion process; and 4) Transmission and other rotating components within the driveline. Typically for an automobile that is in good operating condition with a properly functioning exhaust system, the overwhelming majority of noise is produced by the tire to pavement contact. The problem is further aggravated by the fact that for many high speed highways and interstates, codes require the use of transverse grooves to aid in shedding water from the surface to minimize hydroplaning. Because of the typical highway speeds (55 to 70 MPH), and the regular spacing of the grooves, the action of the tire tread is to have a portion of the contact patch actually alternately contact and not-contact the road surface. This action causes a dominant noise frequency component that is proportional to the speed of the tire and the regular spacing of the rain channel grooves. This tone most usually manifests itself as a whistle or whining noise, which is actually comprised of a relatively narrow spectrum of signals centered around a single dominant component.

The dominant tone can be defined as the fundamental frequency of oscillation of the tire to road interface. This dominant tone frequency can be calculated from the following relationship: Tone (Hz)=(MPH*17.6)/Groove Spacing (in inches).

For example, for a vehicle traveling at 60 MPH and a groove spacing of 1 inch, the dominant frequency produced is 1056 Hz. FIG. 1A illustrates in a cross sectional view such groove spacing.

The spectral energy density profile for a single tone would be represented by the diagram FIG. 2A.

It is apparent that most of the acoustic noise energy is concentrated around the dominant tone frequency which is a function of the line/groove spacing and the vehicle speed. Previous efforts such as in U.S. Pat. Nos. 4,105,458 and 4,396,312 have been directed at the road surfacing materials used. Any noise reduction was more or less a side effect. However, the present invention is directed specifically to noise reduction irrespective of the choice of materials used for road surfacing. The application of random transverse grooves has been addressed by the North Dakota Department of Transportation (NDDOT), Materials and Research Division, "Evaluation of Tining Widths to Reduce Noise of Concrete Roadways Final Report", and LEE etal. (Korean Patent 2004005583). In both these applications acknowledgement has been made as to the effectiveness of random patterns but the apparent benefits are less than optimal due to the insufficient pattern repetition lengths and due to the fact that those patterns used were not generated by a random mathematical process. The narrow spectrum gains of short or repetitive patterns are of limited benefit.

BRIEF SUMMARY OF THE INVENTION

This invention provides a passive technique for mitigating the effects of the noise generated by the high speed tire to road contact. By applying a method employed in communication systems that essentially trades peak signal power for bandwidth (energy is the same since it is proportional to the area under the curve), one can achieve a fairly dramatic reduction in signal amplitude (volume in the acoustic analogy) by spreading the acoustic energy generated across a wider bandwidth. This technique is what is employed in spread spectrum communications systems, CDMA cellular, etc. . . . In accordance with the present method, the road surface is provided with a randomized pattern of grooves. The technique of randomization described employs the use of a polynomial called a maximal linear code sequence. The maximal linear code (also known as maximal linear sequence) polynomial is used to generate the line spacing for a non-repetitive pattern of grooves to be used in roadway construction. The use of maximal linear codes provides for the most robust and longest non-repetitive code by any given delay element or combinatorial summation of feedback outputs from a polynomial. Additional information on the unique properties of maximal length sequence polynomials is available from a wide variety of sources on the WEB as well as the following:

1. Robert C. Dixon *Spread Spectrum Systems,* 1984 John Wiley and Sons, Inc. pp. 86-91
2. T. G. Birdsall, M. P. Ristenbatt, Introduction to Linear Shift Register Generated Sequences, University of Michigan Research Institute Technical Report, October 1958
3. http://en.wikipedia.org/wiki/Maximum_length_sequence (Good tutorial of the noise spectral properties of Maximal Length Sequence polynomials)

The randomization can be as to position, frequency and/or depth to spread the noise spectrum and reduce the volume of noise at any single frequency. These and other advantages of the invention, as well as additional inventive features will be apparent from the description of the invention provided herein. The preferred embodiment in the detailed description of the invention provides a mathematical description of the best practice implementation.

DETAILED DESCRIPTION OF THE INVENTION

Figure 1:
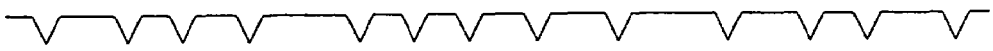
FIG. 1 is a diagrammatic representation of a pseudorandom line/groove spacing (centered at 1") in a road surface which produces a reduced peak amplitude of an acoustic signal.
Figure 2:
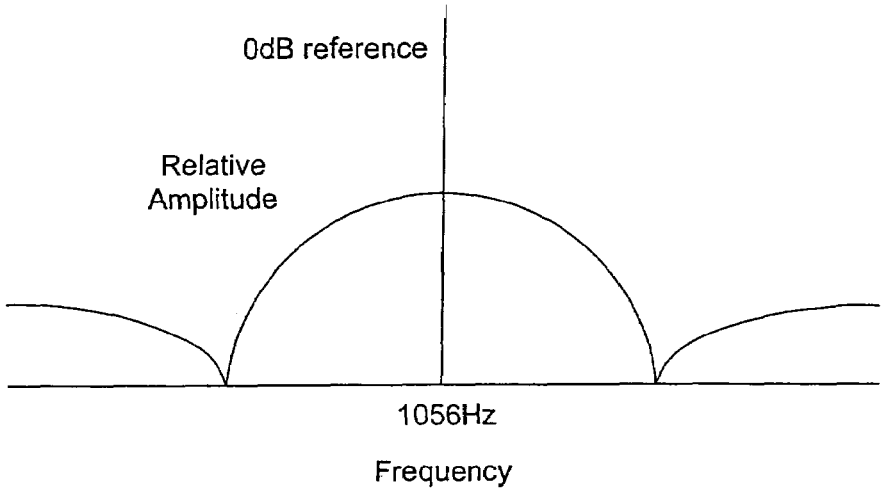
FIG. 2 is a spectral energy density profile for a spread tone.
Figure 3:
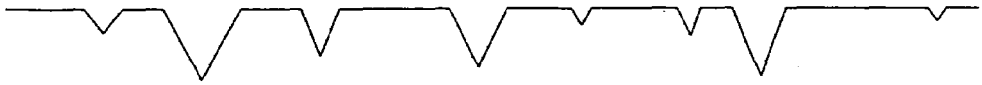
FIG. 3 is a diagrammatic representation of a randomization of both line spacing and groove depth.
Figure 1A:
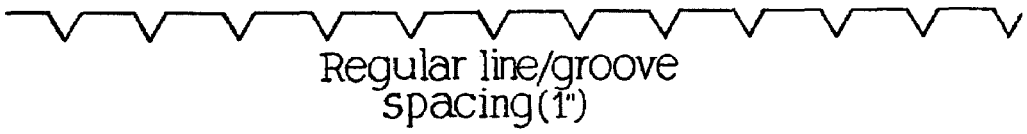
FIG. 1A is a diagrammatic representation of a cross section of a regular line/groove spacing.
Figure 2A:
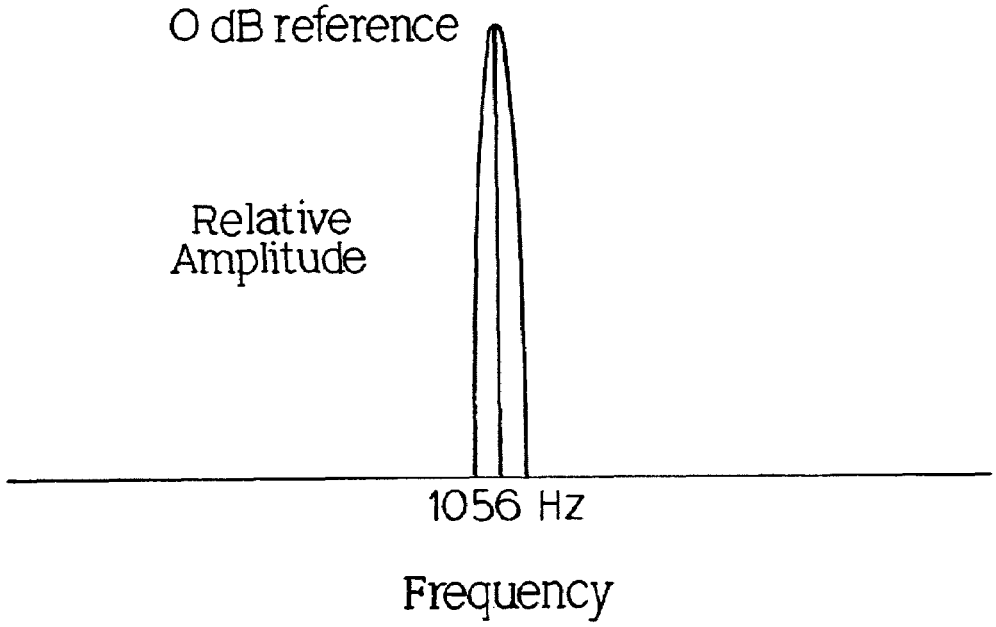
FIG. 2A is a spectral energy density profile for a single tone.

The spreading of the acoustic energy on a road surface in accordance with the present invention can be achieved by several method variations. A preferred method would be to introduce a certain amount of randomness in the spacing of the lines in the road. The amount of randomness can be relatively small and could be generated by unique line patterns that actually repeat over a spacing of as few as a couple hundred lines. This pattern can be generated by the multiplication or convolution of a pseudorandom number with the average desired line spacing (in this example spaced by about 1 inch). The preferred and most effective implementation would specifically implement a line pattern given by a polynomial of the form:

$$1+x+x^2+x^3+x^4+\ldots,$$

Where each x coefficient represents one unit of time delay. In this particular case it makes no difference what the unit of delay is since the technique would scale to the appropriate delay required which depends on vehicle speed. The polynomial in this case takes the form of a maximal length sequence generator. For typical highway traffic speeds (approx. 60 MPH) one would quantize the delay so as to produce line spacings that have an average pitch of approximately 1 to 2 inches. The outputs of each delay element are chosen in such a way that the randomness of the resultant code is optimized. The polynomial in this case is implemented as a feedback shift register. To use this polynomial in practice one would choose a tap or output of either the first coefficient (x) and or the second coefficient ($x^2$) and or the third coefficient ($x^3$) . . . . By summing the outputs of these coefficients (tables of maximal length linear sequence coefficients are widely available and in use by those skilled in the art), one is able to construct a delay generator whose output is proportional to the desired spacing (or in this case time delay since the vehicle is moving). Summations of the various combinations of outputs from these delay elements are available from a multitude of sources. As described above, for a vehicle traveling at 60 MPH with a line pitch of 1 inch the fundamental tone produced is 1056 Hz. The time delay is the inverse of the frequency or approximately 1 millisecond, which becomes the fundamental unit of delay. The summation of the chosen delay tap coefficients then produces the pattern of lines at 1 mS intervals (1 inch nominal intervals at 60 MPH). The output of the summed polynomial would either be a 1 or a 0 at each 1 mSec interval. An output of "1" could represent a line being present and an output of a "0" could represent a location that does not have a line. Ideally each of these codes is chosen so that one random (auto-correlation) peak is produced. It is this property that optimizes the choice of line spacing that reduces the road noise spectral density to a minimum.

In the preferred embodiment one would realize the greatest benefit with sequence lengths that don't repeat very often. Line patterns with repetition lengths greater than 250 are probably most beneficial but patterns as long as 2600 lines may still provide additional benefits. The longer the pattern the more effective the randomness becomes. In general this technique can be applied to any sequence length chosen.

As an example one would apply the above theory to arrive at the following implementation polynomials:

| Length | Equation | Code |
|---|---|---|
| $2^7-1$ | $1+x+x^7$ | 127 bits |
| $2^9-1$ | $1+x^4+x^9$ | 511 bits |
| $2^{12}-1$ | $1+x+x^4+x^6+x^{12}$ | 4095 bits |
| $2^{15}-1$ | $1+x+x^{15}$ | 32767 bits |

In the first polynomial the taps with exponents 7 and 1 are summed to form a linear code with optimal random properties. In the second example the exponents 9, 4 and 1 would be summed. Tables of optimal feedback connections for these exponents are widely known.

The implementation can be applied to any sequence length, but practical limitations exist with implementations of very long sequences. Each of the equations shown describes a successively longer and therefore more optimal method of generating the sequence that one would use to make the rake, or cut the lines etc. The first equation would provide for the shortest sequence. The first equation for example could be implemented with a rake or float or similar device with a pattern described by the equation and it would have 127 tines. The equation describes the position of the 127 tines on the surface of the rake. The longer patterns describe somewhat more effective patterns but would probably require cutting or embossing since the pattern length would only repeat in 10's of feet (probably too long for a rake or multiple sets of rakes).

The invention does not require any sort of feedback or measurement of already existing noise on the road surface i.e. it does not have to adapt to conditions but is fixed and its pattern is only described by the equation. The method describes the optimal placement for the lines to cause the noise generated to be at a minimum under any traffic conditions. This minimum is independent of the speed or type of traffic.

Transverse grooves or lines with this pseudorandom spacing will effectively reduce the amplitude of the noise generated at any one frequency and broaden the spectrum, making the noise that is generated more like "white" noise.

As an example, if one uses one inch as an average groove spacing and applies a pseudorandom variation in groove spacing such that the spacing can take on any value between 0.5 inches and 1.5 inches, one gets an acoustic signal that will decrease in peak amplitude and have nulls separated by 1056 Hz with sidebands that have frequency domain spectral components that theoretically extend to plus and minus infinity.

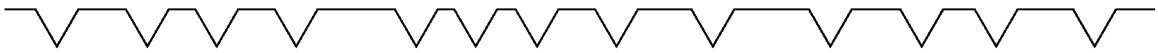

Psuedorandom line/groove spacing (centered at 1″)

It can be clearly seen that a dramatic decrease in noise amplitude can be achieved through the use of line pattern randomization (simulations have shown a 16 dB decrease in peak amplitude). The total acoustic energy level remains the same but the randomization of the lines in the pavement causes a spreading of the acoustic energy present thus reducing the amplitude of the single dominant tone due to tire/road contact.

Another method variation that can be used to minimize the dominant frequency is to combine groups of grooves that have a regular spacing (maybe 5 to 20 grooves) with areas on the pavement that have no grooves. The area that is free of grooves could have a width that is randomized by similar means to that described above. This method variation would probably be somewhat less effective since it would still produce a dominant tone however on average, the amplitude would be reduced by the fact that the groups of lines have pseudorandomly placed areas that do not contain lines.

It is believed that the present methods could be applied in road construction practice to reduce the effects of high speed traffic noise in residential areas, possibly eliminating or greatly reducing the necessity of building noise fences and barriers. The application of this invention also will not affect the overall cost of producing the road itself, since it utilizes the exact same techniques that are currently state of the art in the road construction industry.

A third variation for the purpose of noise reduction in road surfaces would involve the application of grooves that vary in depth thereby causing a variation in amplitude due to the fact that the elastic collision between the tire and the road surface would vary in amplitude on a pseudorandom basis. The most effective approach might be considered a fourth embodiment, and that is the application of both amplitude (groove depth) and position of grooves. By randomizing the position of lines and the depth of the grooves a further reduction in single frequency acoustic energy can be had. It is felt that any of these approaches could be implemented at little additional cost yet realize large gains in road noise performance due to the spreading of the acoustic energy present.

For maximum noise reduction, the spreading functions used for the generation of the depth profile and the line position should be relatively orthogonal (i.e. Gold codes).

Figure 4:
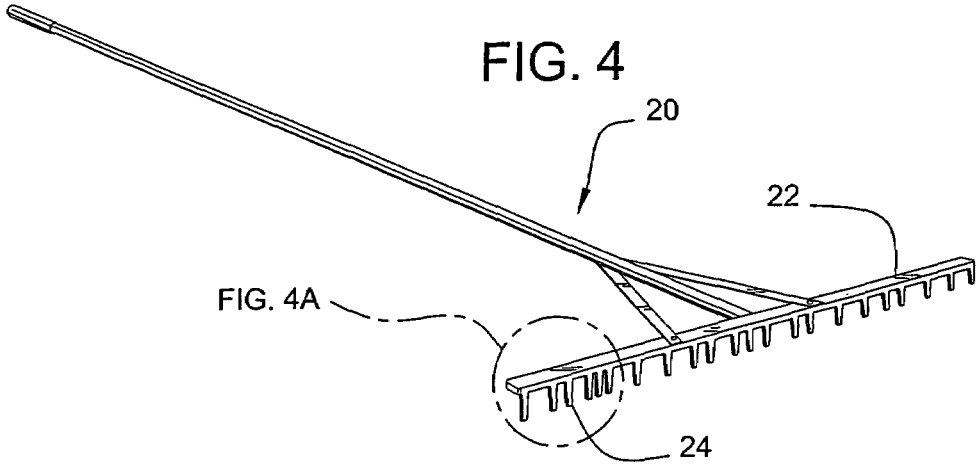
FIGS. 4 and 4A-B are representations of a rake tool for producing the random pattern.
Figure 4A:
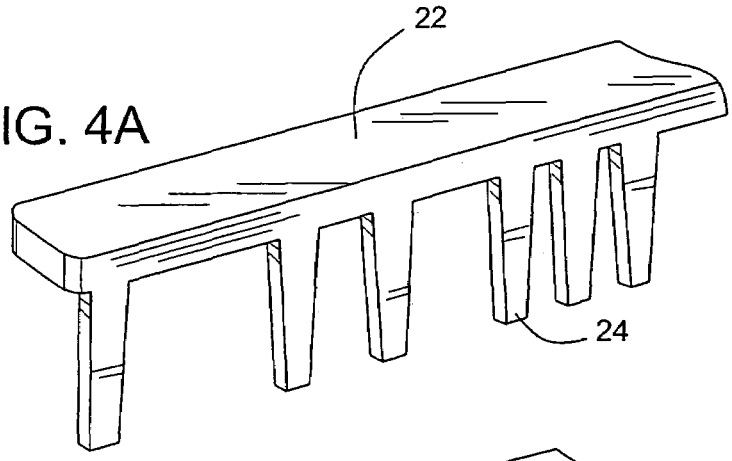
Figure 4B:
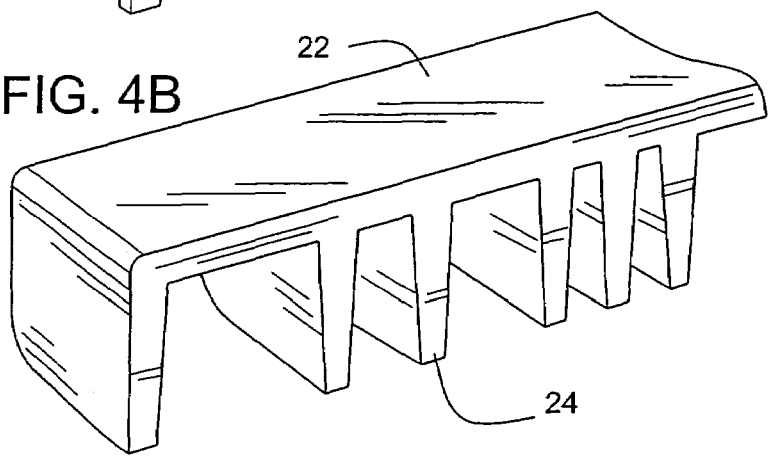
Figure 5:
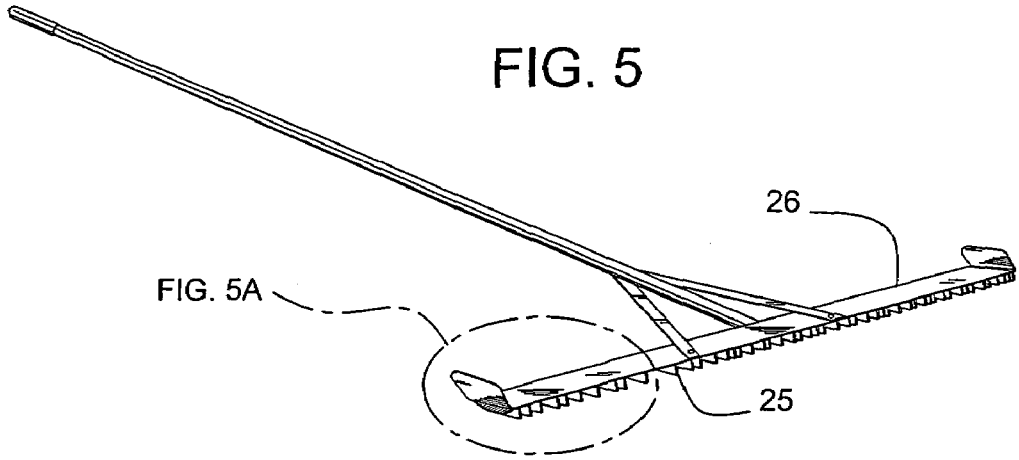
FIGS. 5 and 5A are floats for pattern production.
Figure 5A:
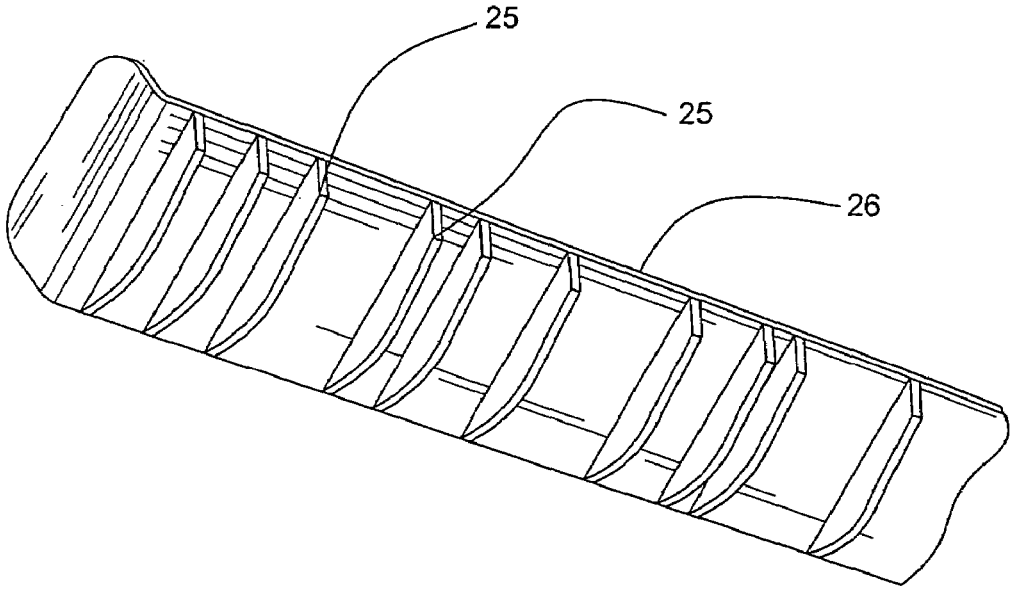

There are many industry standard methods for imparting the grooved surface texture using rakes, floats, stamps (embossing), and cutting. A method of implementing the invention is to score or stamp the road surface after pouring the concrete during the initial curing cycle. Referring to FIGS. 4 and 5, this can be accomplished in at least three ways before curing. One is to use a rake 20 with a broad head 22. The rake 20 would have individual tines 24 that are positioned along the head 22 so that the desired pseudorandom line pattern is embossed or cut into the road surface. The second implementation is to position protrusions 25 on the bottom surface of a float 26 which is done as a final process after the final surface finish is given to the road surface. Again in the case of the float, the protrusions 25 are spaced in accordance with the pseudorandom pattern desired. In both these cases the tool is drawn transversely across the road surface and then indexed at the appropriate point so that there is no overlap in the tooled grooves in the road surface. Since there are practical limitations to the width of the head of the rake or float one could make a set of tools that consist of a set of rakes or floats that each had a unique pseudorandom pattern. For example, if one could make a rake or float with a head width limited to 6 feet and the average pitch (distance between grooves) was set at 2 inches then one tool (rake or float) could realize a pattern that was limited to: (6 ft)×(12"/1 ft)×(pattern length)/(2 in)=36 grooves.

Since in this example one rake or float is capable of providing a pattern which is relatively short, one could envision a set of three that would provide a unique and non-repetitive pattern of 36×3=108 grooves. It can be shown that patterns of this length can provide sufficiently uncorrelated acoustic spectra to be useful. Ultimately the longer the pattern the more noise like the acoustic spectrum.

A third approach to obtaining the desired pattern would be to use an embossing or stamping process. This is most typically done with rubber or other suitable material that is used as a pattern master. The pattern is cast or machined into the mould and it is then applied to the roadway to cast the mating surface. This stamping is done prior to the full cure of the roadway material. Versions of this technique are commonly used in ornamental concrete work.

A fourth way to realize the invention is to cut lines into cured road material using a diamond cutting tool or other suitable tool. This can be done by indexing a single cutting element in a pseudorandom fashion or by the creation of a cutting tool that has multiple cutting elements and cuts many lines/grooves at once.

Also, shown are float or rake devices for imparting the randomized grooves in a road surface during construction. Stamps or embossing techniques may be employed likewise during construction. Cutting is also possible in finished roads.

Since there are many industry standard methods for imparting the grooved surface texture using rakes, floats, stamps (embossing), and cutting. The FIGS. 4 and 5 devices suggest a couple inexpensive implementations that are ready adaptations of existing road building tools. Not shown are detailed drawings showing the embossing or stamping process.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

I claim:

1. A method for construction of a roadway surface having reduced tire to road noise generated by movement of said tire over the surface of said road as said tire is engaged against and rotates over said surface in the direction of said roadway, said method comprising the steps of forming the roadway surface with a series of spaced grooves having one or more features selected from the group consisting of the (1) spacing of said grooves, (2) depth of said grooves, and (3) the distance between sets of spaced grooves wherein the selected feature is characterized by a maximal liner code sequence.

2. The method of claim 1 wherein said feature is constructed using at least one method selected from the group consisting of (1) raking of a pattern, (2) embossing a pattern of grooves, and (3) cutting a pattern of grooves.

3. A roadway surface construction having reduced tire to road noise generated by movement of said tire over the surface of said roadway as said tire is engaged against and rotates over said roadway surface in the direction of said roadway, said surface comprised of a plurality of spaced grooves in said direction of said roadway, said grooves constructed in a pattern selected from the group consisting of (1) varied spacing of the grooves, (2) varied depth of said grooves, (3) varied distance between sets of said grooves and combinations thereof, and (4) said variance characterized by a maximal linear code sequence.

* * * * *